United States Patent [19]

Marelin et al.

[11] Patent Number: 4,928,738

[45] Date of Patent: May 29, 1990

[54] TOOL FOR TIGHTENING CABLE TIES

[75] Inventors: Miklos B. Marelin, Denver; Hans R. Hinnen, Lakewood, both of Colo.

[73] Assignee: Idex, Inc., Denver, Colo.

[21] Appl. No.: 224,562

[22] Filed: Jul. 25, 1988

[51] Int. Cl.[5] ..... B21F 9/02

[52] U.S. Cl. ..... 140/93.4; 140/123.6; 140/152

[58] Field of Search ..... 81/9.3; 140/93.2, 93.4, 140/123.5, 123.6, 150, 152, 153, 154

[56] References Cited

U.S. PATENT DOCUMENTS

| | | | |
|---|---|---|---|
| 2,087,655 | 7/1937 | Prestwich | 140/123.6 |
| 2,210,510 | 8/1940 | Sutton | 140/123.6 |
| 2,312,400 | 3/1943 | Govanus | 81/9.3 |
| 2,882,934 | 4/1959 | Gerrard | 140/153 |
| 3,610,296 | 10/1971 | Kabel | 140/123.6 |
| 4,041,993 | 8/1977 | Angarola | 140/93.4 |
| 4,726,403 | 2/1988 | Young et al. | 140/123.6 |
| 4,747,433 | 5/1988 | Dixon | 140/150 |

FOREIGN PATENT DOCUMENTS

| | | | |
|---|---|---|---|
| 658135 | 2/1963 | Switzerland | 140/123.6 |

OTHER PUBLICATIONS

Electro Adapter, Inc. Introduces "CBS Calibrated Banding System" (brouchure–four pages) (undated).

Sunbank Electronics, Inc., "Yesterday, Today and Tomorrow Sunbank Meets the Challenge" (Brochure–4 pages) (undated).

*Primary Examiner*—Lowell A. Larson

*Attorney, Agent, or Firm*—Sheridan, Ross & McIntosh

[57] ABSTRACT

A method and apparatus for tightening band-type clamps in a desired tension is provided. The device includes operating handles for compact and one-handed operation. A pinching roller provides tensioning by means of a first handle. A second handle accomplishes bending or locking and cut-off without the necessity for rotating the tool as a whole. The tensioning handle folds tightly against or into the body when the desired tension is attained, providing a signal that the desired tension has been attained. The tool is foldable to a compact storage configuration and provides for reversal of a cutting device to provide a new cutting edge when the old cutting edge becomes worn.

19 Claims, 10 Drawing Sheets

TOOL FOR TIGHTENING CABLE TIES

FIELD OF THE INVENTION

The present invention relates to a method and apparatus for tightening band-type clamps and, in particular, a method and apparatus for providing a desired tension and for locking and shearing a free end cable tie clamp.

BACKGROUND OF THE INVENTION

Band-type clamps are commonly used for applying radial compression to an object, typically for connecting or attaching objects. A cable tie clamp is often employed for bundling or attaching electrical cables and/or cable connectors. In one instance, cable tie-type clamps are used to connect braided shielding of electrical cable to a connector (such as a "back shell" connector) or adaptor. In many applications, particularly military applications such as military aircraft, such clamping of shielding to a connector or adaptor must meet a number of specifications, such as the amount of pressure which the clamp provides, the amount of tension on the clamp strap, and/or the resistivity between the braided shielding and the adaptor or connector.

Tools or devices have been provided for tensioning a band clamp or cable tie and particularly directed to military and/or military aircraft applications. However, previous apparatus and methods have suffered from a number of deficiencies. Some previous systems have used a toothed mechanism for pulling or tensioning the strap which can result in creation of metal shavings which can have an undesirable effect on the workpiece, environment or the tool itself or can result in marring the free end of the strap interfering with reuse of the strap and with removal of the cut-off portion of the strap from the mechanism. Toothed mechanisms are also typically sensitive to small imperfections in band thickness which ca result in jamming or slippage of the tool. Some previous devices required use of more than one tool, for example, requiring switching tools after tensioning and before locking and/or cutting the free end of the strap. Some previous apparatus have required that the tool as a whole be moved or rotated with respect to the cable tie in order to accomplish locking or cutting off the free end of the tie. This requirement is particularly disadvantageous in close quarters where such manipulation of the tool cannot easily be accomplished. Some previous apparatus have been heavy and/or bulky or have required a relatively large amount of space because, for example, the apparatus, at least during a part of the operation, is configured in an orthogonal shape, such as T-shape or L-shape. Some previous devices require the use of two hands to tension, lock and cut off the band.

Accordingly, there is a need for a method and apparatus for tensioning, locking and cutting off a band-type clamp which is light-weight, compact, operable with a single hand, does not require rotating the tool as a whole, does not mar the band or create metal shavings, and requires only a single tool.

SUMMARY OF THE INVENTION

The present invention includes a method and apparatus for tightening a band clamp and locking the clamp under tension without moving or rotating the tool as a whole. The device includes operating handles or levers at an acute angle to the body of the tool to provide for compact operation and one-handed operation. The device provides for tensioning by a pinching roller scheme without the necessity for toothed tensioners. The device allows for adjustment of both the total band tension achieved and the amount of tensioning per power stroke. The invention includes a single tool which accomplishes tensioning, bending or locking and cut-off. The tool is foldable to a compact storage configuration, provides for substantially orthogonal bending or locking of the strap, and provides for reversal of a cutting device to provide a new cutting edge when the old cutting edge becomes worn.

DETAILED DESCRIPTION OF THE PREFERRED EMBODIMENTS

The present invention relates to a method and apparatus for use with cable ties. A typical cable tie is comprised of a strap with one end attached to a buckle and a free end which is wrapped around an object or objects and then passed through the buckle. Once the free end is passed through the buckle, the strap can be tightened about the object or objects by pulling on the free end of the strap. After the desired tension is attained, the free end of the strap can then be bent around the top edge of the buckle to fix the free end of the strap in place. It is then desirable to shear off the free end of the strap so that the cable tie lies flush to the object or objects. Accordingly, the present invention operates to tighten a cable tie to a desired tension, bend the free end of the strap around the top edge of the buckle (thereby attaching the free end of the strap to the buckle), and then shear off the free end.

Figure 1A:
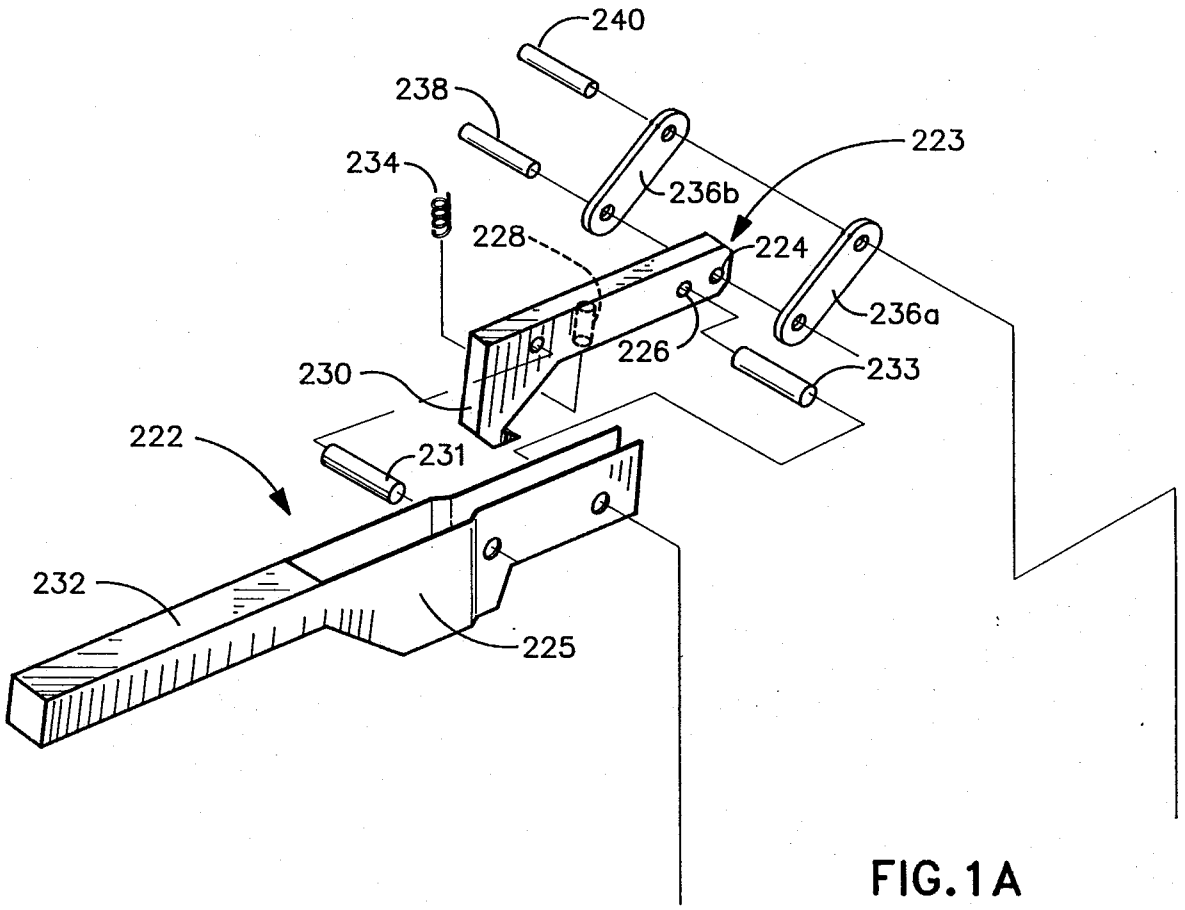
FIG. 1 is an exploded, perspective view of an apparatus according to the present invention presented on three sheets denoted FIG. 1A, FIG. 1B, and FIG. 1C.
Figure 1B:
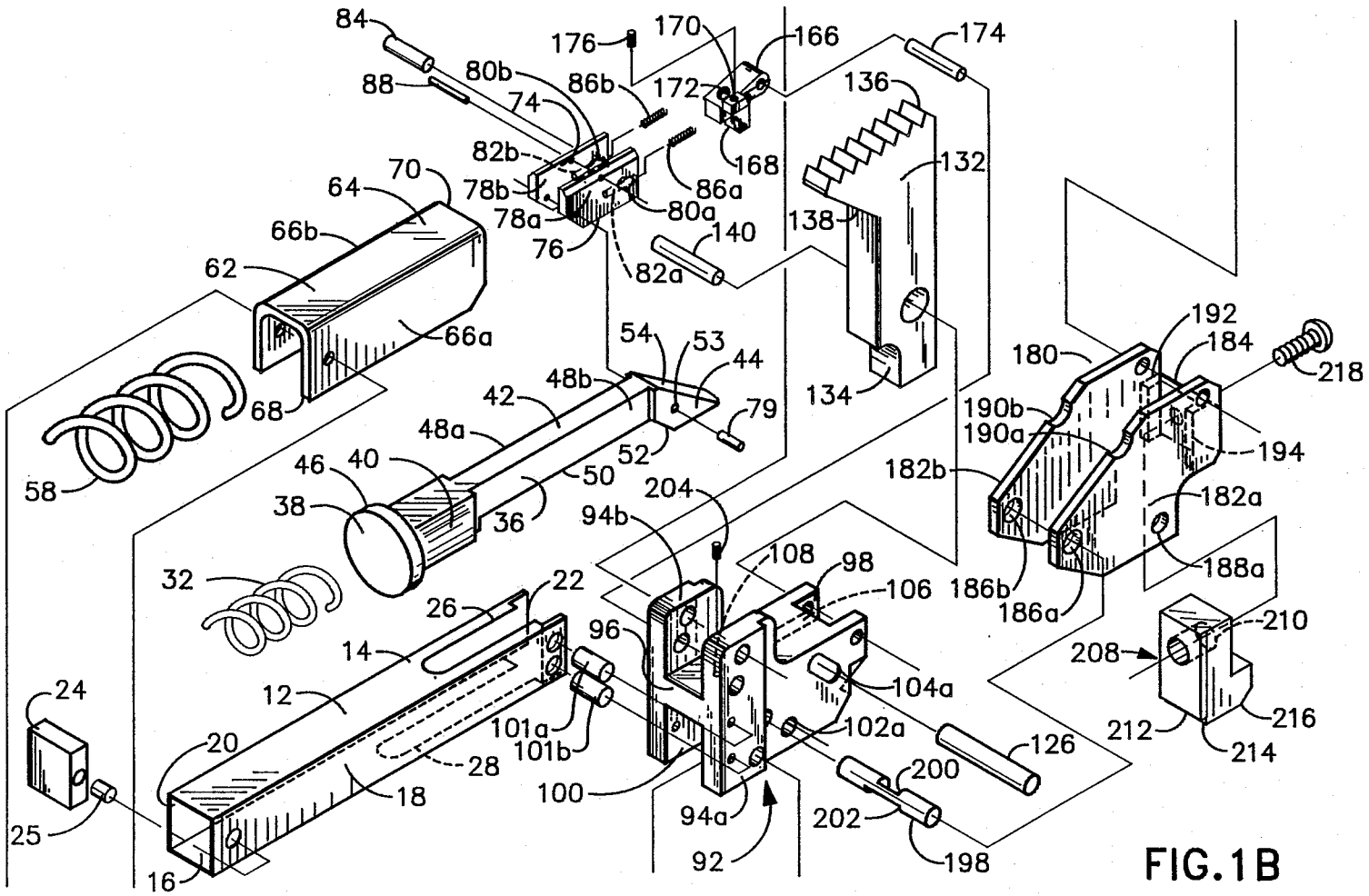
Figure 1C:
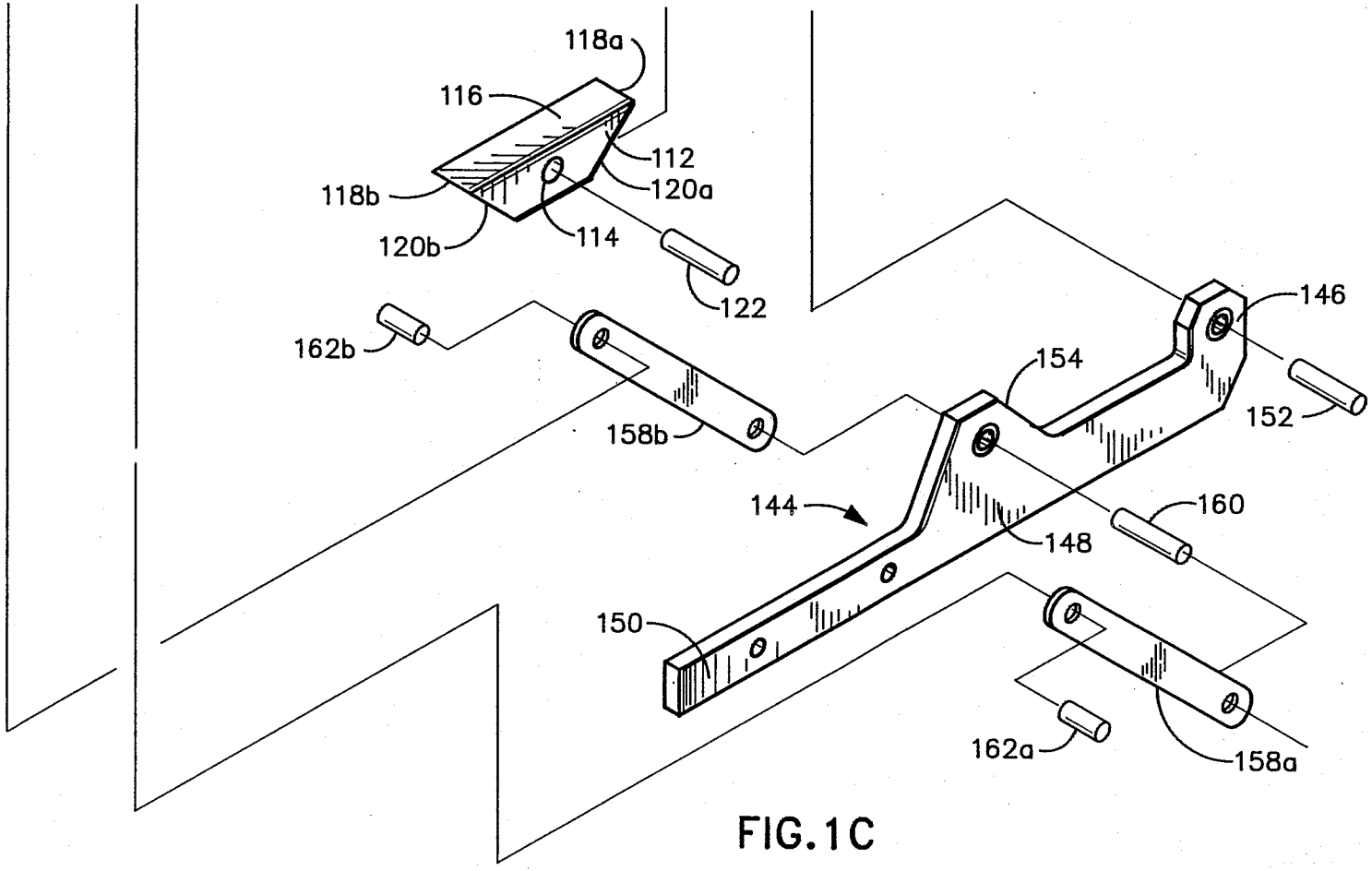

The preferred embodiment of the invention, a tool 10, is illustrated in FIG. 1. The tool 10 includes a body 12 for housing various components that comprise the tool. The body 12 has a body top 14, a body bottom 16, a first body side 18, a second body side 20, an open end 22, and a removable cap end 24. The cap end 24 is attached to the open end 22 by, e.g., a pin 25. The body top 14 and the body bottom 16 each have, respectively, a first body slot 26 and a second body slot 28 which allow components housed within the interior of the body 12 to communicate with components residing outside or exterior to the body 12. The cap end 24 is removable to allow access to certain components housed within the body 12.

A first spring 32 used for, among other things, defining the tension to be applied to the strap and reciprocating a pull-up arm, resides within body 12 with one end contacting the cap end 24.

The present invention also includes a bridge member 36 for use in applying tension to the free end of a strap. The bridge 36 has a flanged end 38, a first bridge portion 40, a second bridge portion 42, and a third bridge portion 44. The bridge member 36 resides in the body 12 and is oriented such that the flanged end 38 contacts an end of the first spring 32. Consequently, the ends of the first spring 32 contact the cap end 24 of the body 12 and the flanged end 38 of the bridge member 36. A first shoulder 46, defined by the connection between the flanged end 38 and the first bridge portion 40, provides a contact surface for one end of a spring used, among other things, in tensioning the free end of the strap. The first bridge portion 40 functions to guide the spring that contacts the first shoulder 46. The second bridge portion 42, of smaller cross-sectional area than first bridge portion 40, includes a pair of narrowed sidewalls 48*a*, 48*b* and a notched bottom side 50. The narrowed sidewalls 48*a*, 48*b* in conjunction with a channel member define a pair of slots occupied by linkage mechanism used in the tool 10, as described below. The notched bottom side 50 includes a first angled surface 52, which cooperates with other elements of the tool 10, namely a pull-up arm, to indicate when the desired tension on the strap is attained. In the preferred embodiment, the first angled surface 52 is angled at 45° relative to the horizontal. Included in the third bridge portion 44 is a hole 53 for connecting the bridge member 36 to a slide block described below. The third bridge portion also includes a sloped face 54. The sloped face 54 functions in the tool 10 to guide the free end of the strap out through the first body slot 26, thereby allowing the user to remove the free end of the strap after shearing.

The tool 10 further includes a second spring 58 which, primarily, functions to define the tension to be applied to the free end of the strap. One end of the second spring 58 abuts against the first shoulder 46 of the bridge member 36 while the other end contacts a channel member.

Also housed within body 12 is a U-shaped channel member 62 having a channel top 64, channel sides 66*a*, 66*b*, channel rear end 68, and channel front end 70. The channel member 62 is located between the body 12 and the second bridge portion 42 of the bridge member 36 such that the channel rear end 68 contacts the second spring 58. Further, the channel top 64 and channel sides 66*a*, 66*b* of channel member 62 face, respectively, the interior surfaces of the body top 14 and body sides 18, 20. Consequently, the open side of the channel member 62 faces the second body slot 28 thereby defining a pair of recesses between the bridge narrowed sidewalls 48*a*, 48*b* and the interiors of channel sides 66*a*, 66*b*. The recesses, in cooperation with the second body slot 28, provide a pathway for a linkage connecting a pull-up arm to the channel member 62, as described below. Further, it should be noted that the edges of channel sides 66*a*, 66*b* are in sliding contact with the body bottom 16 of the body 12 existing between the second body slot 28 and the body sides 18, 20.

Figure 8:
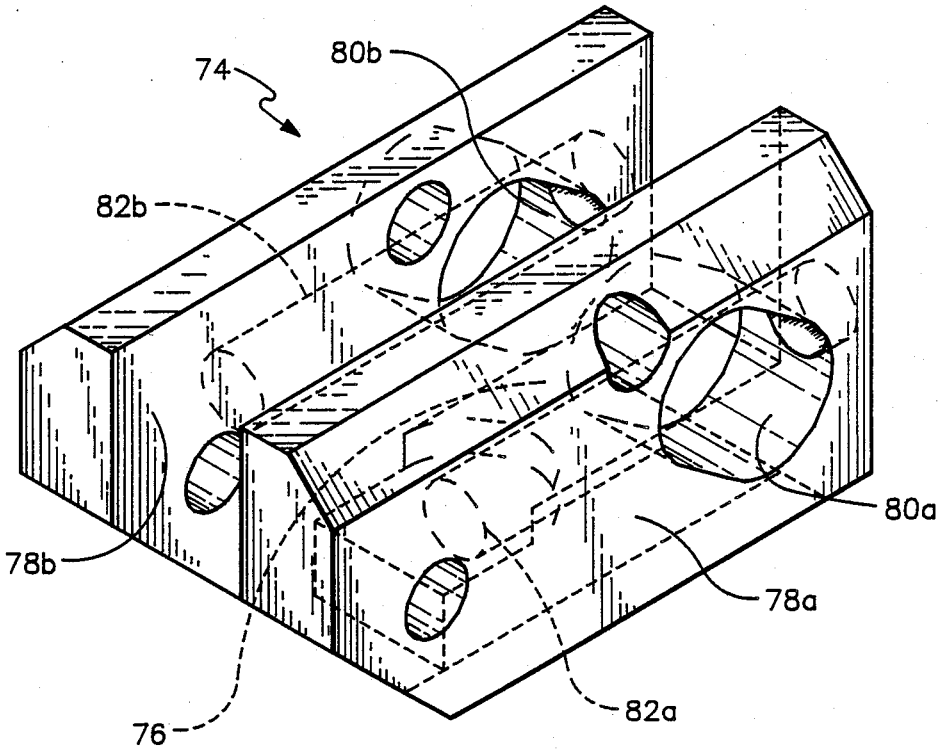
FIG. 8 is a perspective view of the slide block.

The last element entirely housed within the body 12 is a slide block 74 for engaging the free end of a strap and applying tension thereto. Referring to FIG. 8, the slide block 74 is comprised of a slide block bottom 76 and slide block sides 78*a*, 78*b* which face, respectively, the interior surfaces of the body bottom 16 and the body sides 18, 20 in the assembled tool 10. The hole 53 associated with the third bridge portion 44 of the bridge member 36 aligns with a pair of holes in the slide block sides 78*a*, 78*b* thereby allowing a pin or rivet 79 to join the bridge member 36 to the slide block 74. The slide block sides 78*a*, 78*b* include, respectively, rear roller slots 80*a*, 80*b* and rear roller spring holes 82*a*, 82*b*. The rear roller slots 80*a*, 80*b* are sloped at 10°–20°, preferably about 14°, to the horizontal and serve to guide a rear roller 84, which is biased toward the front of the slots by a pair of rear roller springs 86*a*, 86*b* located in the rear roller spring holes 82*a*, 82*b*. The rear roller slots 80*a*, 80*b*, the rear roller 84, and the rear roller springs 86*a*, 86*b* cooperate with the upper surface of the slide block bottom 76 to pinch the free end of a strap therebetween when the slide block 74 is being moved toward the cap end 24. Further movement of the slide block 74 toward the cap end 24 then results in tension being applied to the free end of the strap. The angle of the rear roller slots 80*a*, 80*b*, in general, affects the pressure applied by the rear roller 84 to the band. A larger angle provides less pressure. An angle of 16°–20° can result in some slippage, although this can be partially overcome by using a larger-diameter roller 84. Smaller angles, such as 10°–13°, provide such great pressure that release of the band during the return stroke (as described below) is delayed or made difficult, possibly because of denting, deformation or other marring of the band. Failure of the rear roller 84 to properly release during the return stroke can cause buckling of the band forward of the rear roller 84. Thus, by proper selection of the angles, marring of the band is avoided. Further, by using a roller mechanism, the creation of metal shavings, as is typical of tooth-type tensioners, is avoided.

A keeper pin 88 extending between the slide block sides 78*a*, 78*b* provides a catch for a hook associated with a cutter arm that is received through the first body slot 26 of the body 12. The keeper pin 88 and the hook cooperate to hold a pull-up arm and a cutter arm close to the body 12 when storing the tool 10, as described below.

The tool 10 further includes a head 92 which, among other things, provides attachment and pivot points for a plurality of other elements associated with the tool 10. The head 92 is comprised of head sides 94*a*, 94*b* which are joined by a head cross member 96. The relative orientations of the head sides 94*a*, 94*b* and the head cross member 96 define an upper head recess 98 that contains portions of a cutter arm and a hammer, and lower recess 100 for housing a blade. The body 12 is operatively attached to the head 92 such as by pins 101*a*, 101*b*. Consequently, the body 12, including the cap end 24, and the head 92 cooperate to contain the first spring 32, the bridge member 36, the second spring 58, the channel member 62, and the slide block 74 within the body 12. Also included in head sides 94*a*, 94*b* are blade holes 102*a*, 102*b* which provide an attachment point for a blade whose upper surface cooperates with the lower surface of the head cross member 96 to define a slot through which the free end of a strap can be inserted. Further, head sides 94*a*, 94*b* include front roller slots 104*a*, 104*b* for guiding a front roller used in the tensioning, bending and shearing of the free end of a strap associated with a cable tie. Preferably, the front roller slots 104*a*, 104*b* are disposed at a 13° slant to the horizontal. Located in head cross member 96 is a front roller spring hole 106 for housing a spring that biases a front roller toward the front of the front roller slots 104a, 104b. The head 92 further includes holes for the pivoting attachment of a release lever, a pull-up arm, a hammer, a cutter, and a cutter arm, as described below. Lastly, the head cross member 96 includes a cutter pin hole 108 for holding a set screw which fixes in place a cutter pin that attaches a cutter to the head 92.

The preferred embodiment of the invention further includes a blade 112 having a blade bore 114, a blade top surface 116, blade edges 118a, 118b, and blade ends 120a, 120b. A blade pin 122 extending between the blade holes 102a, 102b and the intermediate blade bore 114 is used to attach the blade 112 to the head 92. The blade 112 is oriented in the lower recess 100 of the head 92 such that the blade top surface 116 faces the lower side of the head cross member 96. Additionally, the blade edges 118a or 118b is rearwardly located from the front of the head 92 to define a space for bending the free end of the strap as described hereinafter. Furthermore, the blade top surface 116 is spaced from the lower side of the head cross member 96 of the head 92 thereby defining a slot through which the free end of a strap can pass. The blade edge 118a is used in both the bending and shearing the free end of a strap. The blade end 120a is sloped or slanted to allow the blade 112 to be closely positioned to the buckle of a cable tie. If the blade edge 118a becomes dull the blade 112 can be reversed such that blade edge 118b replaces blade edge 118a. Reversal of the blade 112 is accomplished by removing the blade pin 122, rotating the blade 112, and replacing the blade pin 122.

A front roller 126 resides in the front roller slots 104a, 104b and is urged or biased toward the front of the slots by a front roller spring 128 anchored in the front roller spring hole 106. The front roller slots 104a, 104b, the front roller 126, and the front roller spring 128 cooperate with the blade top surface 116 to maintain the tension on the free end of a strap when the rear roller 84 and its cooperating parts are not tensioning or pulling on the free end of the strap.

A release lever 132 is provided to disengage the front roller 126 from pinching the free end of a strap. The release lever 132 is comprised of a concave surface 134, a knurled surface 136, and a cutter arm contact surface 138. A release lever pin 140 pivotally attaches the release lever 132 to the head 92. Rotation of the release lever 132 toward the front of the tool 10 causes the concave surface 134 to force the front roller 126 toward the rear of the front roller slots 104a, 104b. Due to the upward slope of the front roller slots 104a, 104b the rearward displacement of the front roller 126 by the release lever 132 relieves any pressure on the free end of the strap. Rotation of the release lever 132 can be accomplished in two ways. First, an operator can utilize the knurled surface 136 to rotate the release lever 132. Typically, this is done when the operator has made a mistake or the tool 10 is jammed. Second, a cutter arm, utilized in the bending and shearing operations of the free end of the strap as described below, following completion of the shearing operation, contacts the cutter arm contact surface 138 thereby causing rotation of the release lever 132. In this instance, the front roller 126 is released so that the sheared free end can be removed from the tool 10.

Further included in the preferred embodiment of the invention is a pull-up arm 144 for use in applying tension to the free end of a strap used in a cable tie. The pull-up arm 144 is comprised of a first pivot end 146, an intermediate portion 148, and a first free end 150. The pull-up arm 144 is pivotally attached at the first pivot end 146 to the head 92 by a pull-up arm pivot pin 152. The intermediate portion 148 of the pull-up arm 144 provides a connection point for a linkage between the channel member 62 and the pull-up arm 144. The intermediate portion 148 further includes a 45° surface 154 which mates with the first angled surface 52 only when the desired tension on the free end of the strap is met or exceeded. For example, when less than the desired amount of tension has been applied to the free end of the strap, the 45° surface 154 will contact the slide block bottom 76 thereby preventing the pull-up arm 144 from contacting the body 12. If, however, the desired tension is attained, the 45° surface 154 mates with the first angled surface 52 of the bridge member 36 thereby serving as an indication to the operator that the desired tension has been attained or exceeded. The first free end 150 is grasped by the operator and used to apply tension to the free end of the strap as described hereinafter.

A pair of pull-up links 158a, 158b provide the linkage between the channel member 62 and the pull-up arm 144. The pull-up links 158a, 158b are pivotally connected to the pull-up arm 144 by a first pull-up arm link pin 160. Similarly, second pull-up arm link pins 162a, 162b connect the pull-up arm 144 to the channel member 62. End portions of the pull-up links 158a, 158b are received in the recesses defined between the narrowed sidewalls 48a, 48b of the bridge member 36 and the interiors of the channel sides 66a, 66b associated with the channel member 62.

Figure 2:
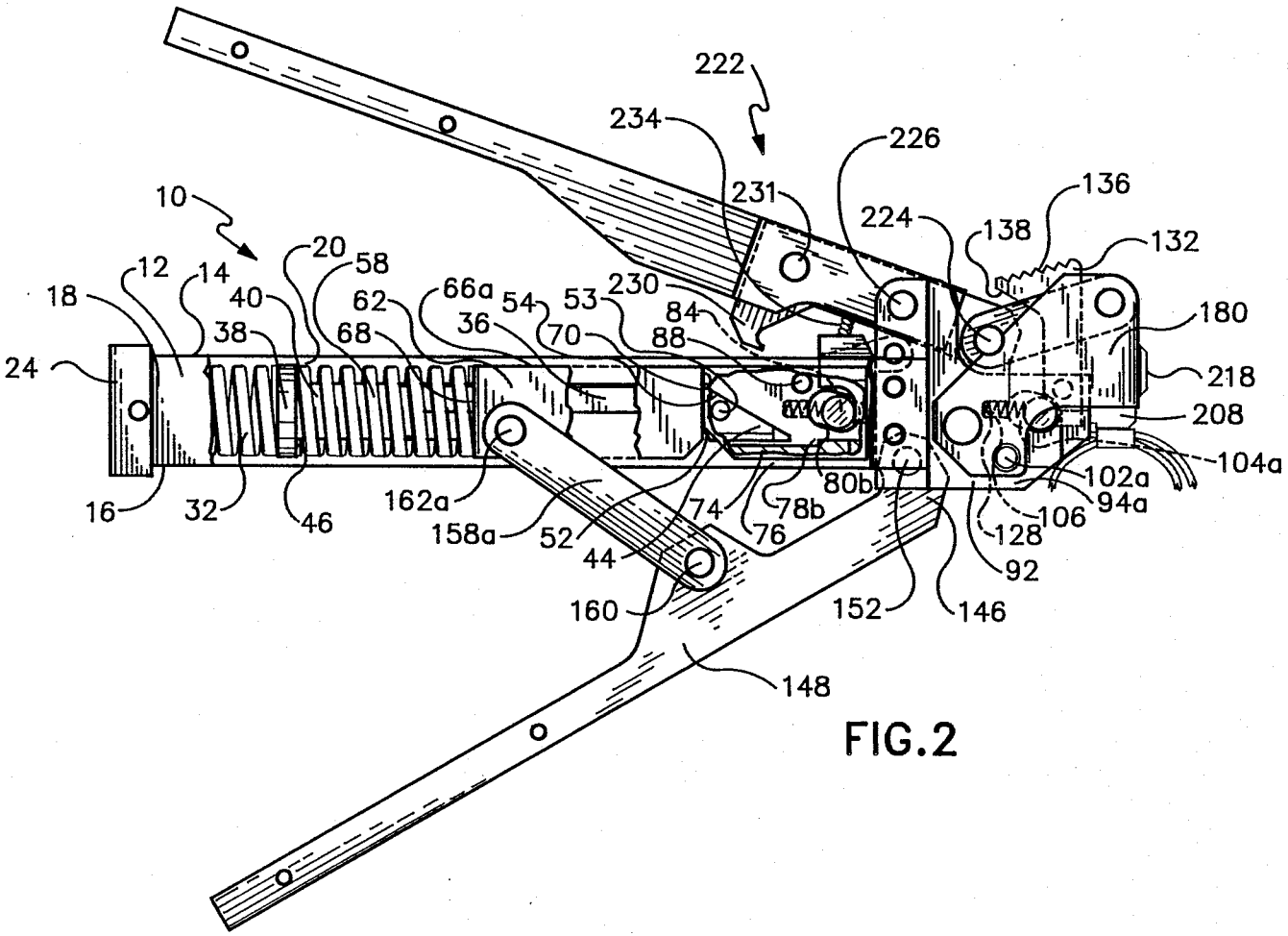
FIG. 2 is a schematic, side elevational view of the apparatus with a pull-up handle and a cut-off handle, each in a first position, and with portions cut-away to show interior parts.

A hammer 166 having a second concave surface 168, a set screw hole 170, and a cutter arm spring hole 172 is provided, primarily, for adjusting the duty cycle of the tensioning mechanism in the tool 10. The hammer 166 is pivotally connected to the head 92 by a hammer pin 174. A set screw 176, extending through set screw hole 170 to contact the body top 14 of the body 12, is provided to adjust the point at which the second concave surface 168 contacts the rear roller 84. For example, by tightening the set screw 176, the second concave surface 168, which contacts the rear roller 84, pivots about the hammer pin 174 thereby forcing the rear roller 84 toward the rear end of rear roller slots 80a, 80b, as depicted in FIG. 2. Consequently, the point at which the slide block bottom 76 and the rear roller 84 cooperate to pinch the free end of a strap is altered. This alteration, as explained hereinafter, alters the duty cycle of the tensioning mechanism associated with the tool 10. The cutter arm spring hole 172 provides a housing for one end of a spring that is used to bias a cutter arm toward an open position.

The components of the tool 10 described thus far comprise the mechanism used to apply a desired tension to the free end of a strap in a cable tie. The components described hereinafter comprise the mechanisms for bending and shearing the free end of the strap.

Further included in the preferred embodiment of the invention is a cutter 180 for use in bending and shearing the free end of a strap. The cutter 180 is comprised of cutter sides 182a, 182b which are joined by a cutter cross member 184. Included in the cutter sides 182a, 182b are cutter bores 186a, 186b which provide a point for the pivotal attachment of the cutter 180 to the head 92 by a cutter pin. A pair of blade access holes 188a, 188b are defined in the cutter sides 182a, 182b to provide access to the blade pin 122 thereby allowing the operator to reverse or replace the blade 112. In addition, a pair of notches 190*a*, 190*b* are provided for governing the movement of a cutter arm. Defined within the cutter cross member 184 is a knife housing 192 for holding a knife used in the bending and shearing of the free end of a strap. Further included in the cutter cross member 184 is a knife screw hole 194 used to attach a knife to the knife housing 192.

A cutter pin 198, having a top recess 200 and a bottom recess 202, is provided for pivotally attaching the cutter 180 to the head 92. The top recess 200 aligns with the cutter pin hole 108 of the head 92. A second set screw 204 extending through cutter pin hole 108 and contacting the top recess 200 of the cutter pin 198 prevents rotation of the cutter pin 198 when the cutter 180 rotates relative to the head 92. Consequently, the bottom recess 202 does not move relative to the head 92 when the cutter 180 rotates about the cutter pin 198. This is important since the bottom recess 202 of the cutter pin 198 intersects the path traversed by the free end of the strap between the front roller 126 and the rear roller 84. By locating the cutter pin 198 in the path transversed by the free end of the strap, the knife associated with the cutter 180 and the blade 112 are substantially at right angles to one another during the bending and shearing operations. Consequently, the free end of the strap is bent at a 90° angle thereby providing a desired attachment between the free end and the buckle. Furthermore, shearing is made easier since the 90° relative positions of the knife and blade result in the free end being sheared at a 90° angle.

A knife 208 cooperates with the blade 112 in the actual bending and shearing of the free end of a strap. The knife 208 is substantially L-shaped so that it can fit in the knife housing 192 of the cutter 180. The knife 208 is comprised of a threaded bore 210, a knife edge 212, a bending edge 214, and a knife bottom surface 216. A second screw 218, extending through knife screw hole 194 of the cutter 180 and engaging the threaded bore 210, allows for the removal and attachment of the knife 208 to the cutter 180. The knife bottom surface 216 and the bending edge 214, upon rotation of the cutter 180 about the cutter pin 198, engage the buckle of a cable tie and apply a force which results in the bending of the free end of the strap, as described below. Notably, the bending edge 214 upon rotation of the cutter 180 is separated from the blade edge 118*a* or 118*b* thereby providing the space necessary to bend, rather than shear, the free end of the strap. Upon further rotation of the cutter 180, the knife edge 212, which is substantially closer to blade edge 118*a* or 118*b*, cooperates with the blade edge 118*a* or 118*b* to shear the free end of the strap.

Also included in the tool 10 is a cutter arm 222 which allows the operator to apply the force necessary to rotate the cutter 180 thereby bending and shearing the free end of a strap. The cutter arm 222 includes an interior portion 223 and a handle 225. The interior portion 223 is comprised of a cutter arm link end 224, a cutter arm pivot point 226, a cutter arm spring hole 228, and a hook 230. The handle 225 includes a free end 232. The cutter arm link end 224 provides a pivotal attachment point for a linkage connecting the cutter arm 222 to the cutter 180 thereby allowing an operator to rotate the cutter 180 to bend and shear the free end of the strap. A cutter arm pivot pin 233 pivotally attaches the cutter arm 222 to the head 92 at the cutter arm pivot point 226. Both the pivot pin 233 and an attachment pin 231 act to attach the interior portion 223 to the handle 225. A cutter arm spring 234 housed in the cutter arm spring hole 172 of the hammer 166 and the cutter arm spring hole 228 bias the cutter arm 222 away from the body 12. The hook 230 cooperates with the keeper pin 88 to permit positioning the pull-up arm 144 and the cutter arm in close proximity to the body 12 thereby providing for easy storage of the tool 10. An operator can grasp the free end 232 and supply the force necessary, increased by the leverage of the mechanical configuration described hereinabove, to rotate the cutter 180 relative to the head 92 thereby bending and shearing the free end of a strap.

Finally, a pair of cutter links 236*a*, 236*b* are used to link the cutter arm 222 to the cutter 180. The cutter arm 222 is pivotally connected by a first cutter link pin 238 to the cutter links 236*a*, 236*b*. Similarly, a second cutter pin 240 connects the cutter links to the cutter 180 thereby completing the linkage between the cutter arm 222 and the cutter 180. Notably, rotation of the cutter arm 222 causes, via cutter links 236*a*, 236*b*, rotation of the cutter 180 which results in the bending and shearing of the free end of a strap.

Having described the various components of the tool 10, it is now necessary to describe how these components cooperate to tension, bend, and shear the free end of a strap associated with a cable tie. The following discussion is broken into two major parts. First, the tensioning operation which is accomplished by inserting the free end 300 of a strap 302 into the tool and manipulating the pull-up arm 144. Second, the bending and cutting operation which is achieved by manipulation of the cutter arm 222. In addition, a discussion of how the pull-up arm 144 and the cutter arm 222 can be collapsed toward the body 12 to place the tool 10 in a storage mode is included.

The tensioning operation of the tool 10 is commenced by initially inserting the free end 300 of a strap 302 into the tool 10. The free end includes all or part of the strap not directly used for banding or wrapping and represents the excess strap, usually extending through or from the buckle. In order to insert the free end of a strap into the tool 10, the cutter arm 222 must be open or rotated away from body 12 such that the first cutter link pin 238 engages the notches 190*a*, 190*b* of the cutter 180 thereby assuring that the knife 208 does not block the entrance to the tool 10. Normally, the cutter arm 222 is maintained in the open position by the cutter arm spring 234. Further, the pull-up arm 144 must be open or rotated away from the body 12 to insure that the rear roller 84 is not engaging the top side of the slide block bottom 76 such that the free end 300 of the strap 302 cannot be further inserted into the tool 10. Having initialized the tool 10, the free end 300 of a strap 302 can now be inserted into the tool 10 such that it passes between the front roller 126 and the blade top surface 116, the bottom recess 202 of the cutter pin 198 and the blade top surface 116, and the rear roller 84 and the top of the slide block bottom 76. Upon passing through the aforementioned passageway, the free end 300 of the strap 302 comes into contact with the first angled surface 54 of the bridge member 36 which guides the free end 300 of the strap 302 toward the first body slot 26 of the body 12 thereby allowing the free end 300 of the strap 302 to be removed following the bending and shearing operations. Insertion of the free end of the strap continues until the front end of the tool 10 comes into contact with the buckle 304. Notably, the width of the slot through which the free end of the strap passes will not accommodate the additional width of the buckle. In essence, the front of the tool 10 engages the buckle 304 and prevents further manual insertion of the strap. Furthermore, since the blade edges 118*a* or 118*b* are rearwardly located from the front of the tool 10 a bending space is defined between the blade edge 118*a* or 118*b* and the buckle 304.

Tensioning of the free end of the strap is accomplished using pull-up arm 144. For ease of understanding the operation of the pull-up arm 144, will be broken down into two segments. First, the power stroke where the pull-up arm 144 is closed or rotated toward the body 12 thereby increasing the tension on the free end of the strap. Second, the retraction stroke where the pull-up arm 144 is opened or rotated away from the body 12 so that another power stroked can be applied to further tension the strap.

Tensioning of the free end 300 of a strap 302 is accomplished by rotating or pivoting the pull-up arm 144 about the pull-up arm pivot pin 152 toward the body 12. Rotation of the pull-up arm 144, in turn, forces, via pull-up links 158*a*, 158*b*, the channel member 62 toward the cap end 24 of the body 12. The rearward motion of the channel member 62 is transmitted to the bridge member 36 by the second spring 58. Consequently, the slide block 74, which is attached to the bridge member 36, is also rearwardly displaced. As the slide block 74 is displaced toward the cap end 24 of the tool 10, the rear roller springs 86*a*, 86*b* tend to force the rear roller 84 toward the front of the rear roller slots 80*a*, 80*b*. The main function of the rear roller spring is to urge the rear roller 84 into contact with the band. The major force by which the rear roller 84 engages the band 302, however, comes not from the rear roller springs 86*a*, 86*b*, but from the geometrical relationship of the parts. As the slide block 74 is pulled farther back, friction between the strap 302 and the rear roller 84 tends to pull the rear roller forward in the rear roller slots 80*a*, 80*b*. Due to the 14° slope of the rear roller slots 80*a*, 80*b*, the forward movement of the rear roller 84 forces the rear roller 84 downward, i.e. toward the top side of the slide block bottom 76 thereby pinching the free end of the strap 302 therebetween. This pinching further increases the friction between the rear roller 84 and the strap. In this manner, the greater the tension on the strap, the higher the pinching force on the strap. Once the strap is pinched between the rear roller 84 and the top of the slide block bottom 76, further rotation of the pull-up arm 144 toward the body 12 causes the free end of the strap 302 to be pulled or drawn toward the rear of the body 12 thereby tensioning the free end of the strap 302.

Figure 3:
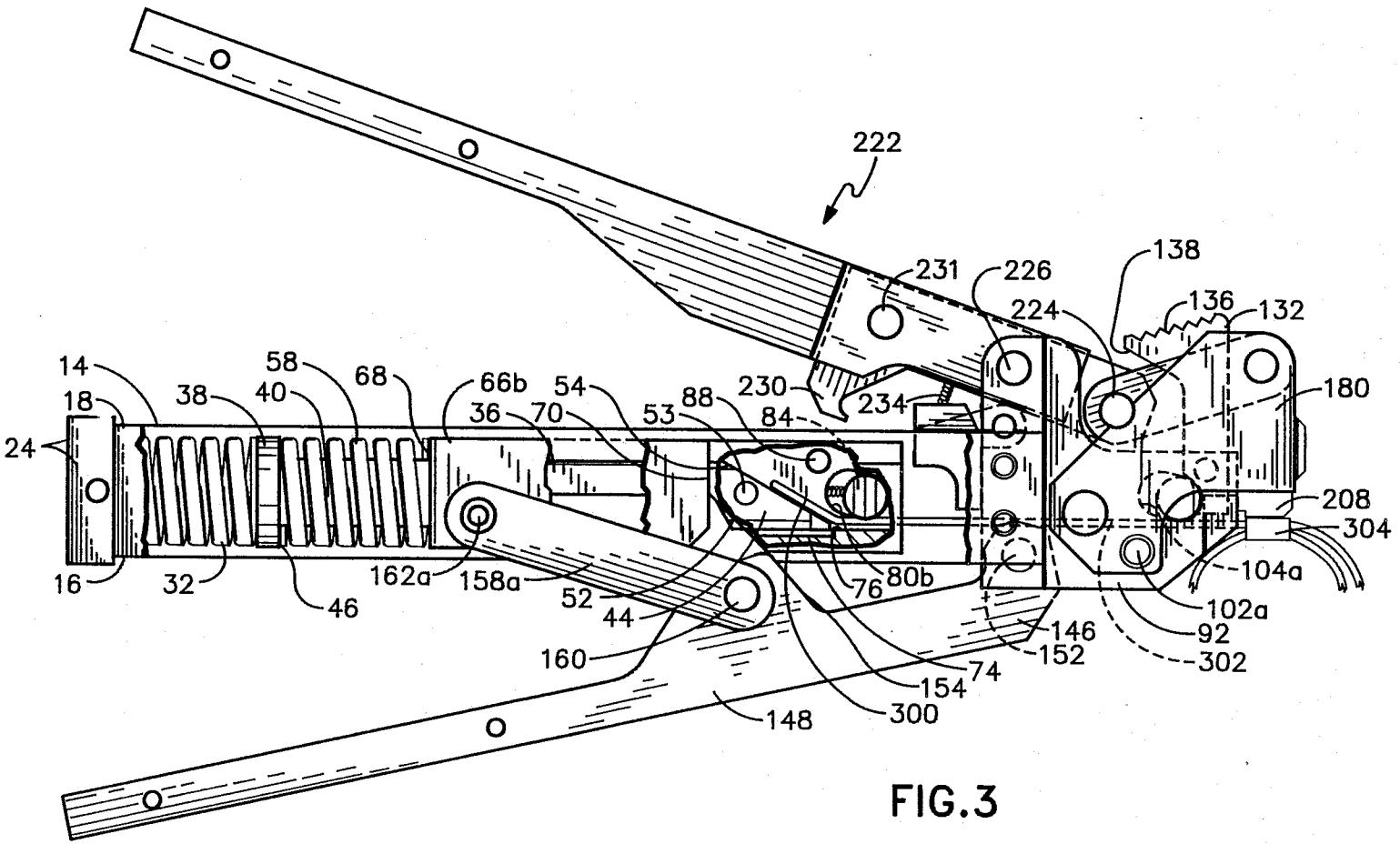
FIG. 3 depicts the apparatus of FIG. 2 with the pull-up handle in a second position.

For clarity of understanding, it is desirable at this point to describe the various forces which apply tension to the free end of the strap 302 and how a desired tension is achieved. Rotation of the pull-up arm 144 toward the body 12 is transmitted by the channel member 62 to the second spring 58. The second spring 58 is, in turn, compressed between the channel rear end 68 and the shoulder 46. Compression of the second spring 58 results in a rearward force being applied to the bridge member 36. This rearward force is opposed by two forces. First, rearward displacement of the bridge member 36 compresses the first spring 32 between the cap end 24 and the flanged end 38 of the bridge member. This compression results in the first spring 32 applying a forward directed force to the bridge member 36. Second, the free end of the strap 302, as it is tensioned, applies a forward-directed force to the bridge member 36. Consequently, in order to achieve rearward displacement of the slide block 74, the force being applied to the bridge member 36 by the second spring 58 must exceed the sum of the forces on the bridge member 36 produced by the first spring 32 and the free end of the strap 302. Providing that the rearward force produced by the second spring 58 exceeds that being produced by the first spring 32 and the tension in the free end of the strap, the 45° surface 154, associated with the pull-up arm 144, will contact the bottom side of the slide block bottom 76 that is exposed by the second body slot 28 of the body 12 thereby preventing complete closure of the pull-up arm 144, as shown in FIG. 3.

Figure 4:
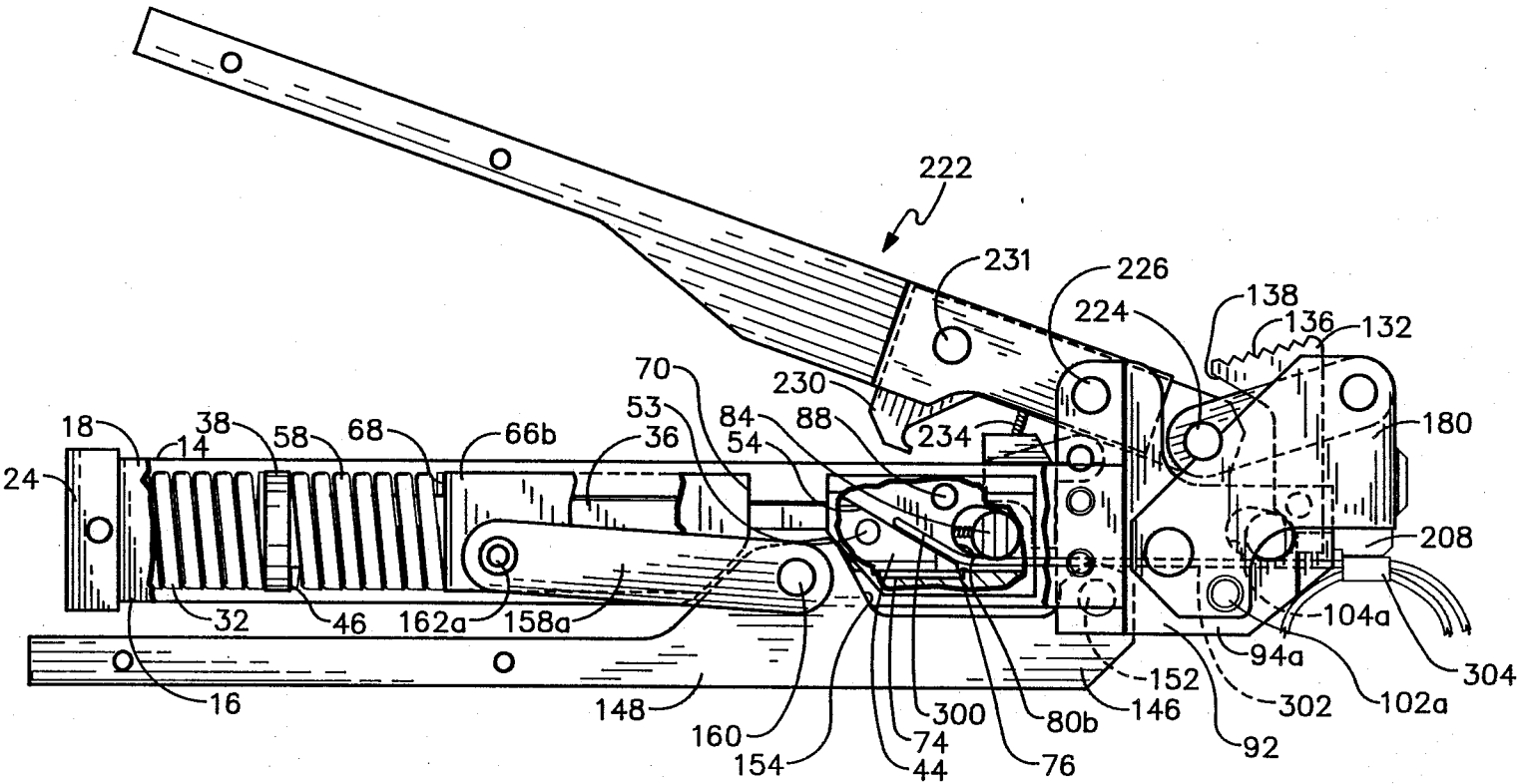
FIG. 4 depicts the apparatus of FIG. 2 but with the pull-up handle in a third position.
Figure 5:
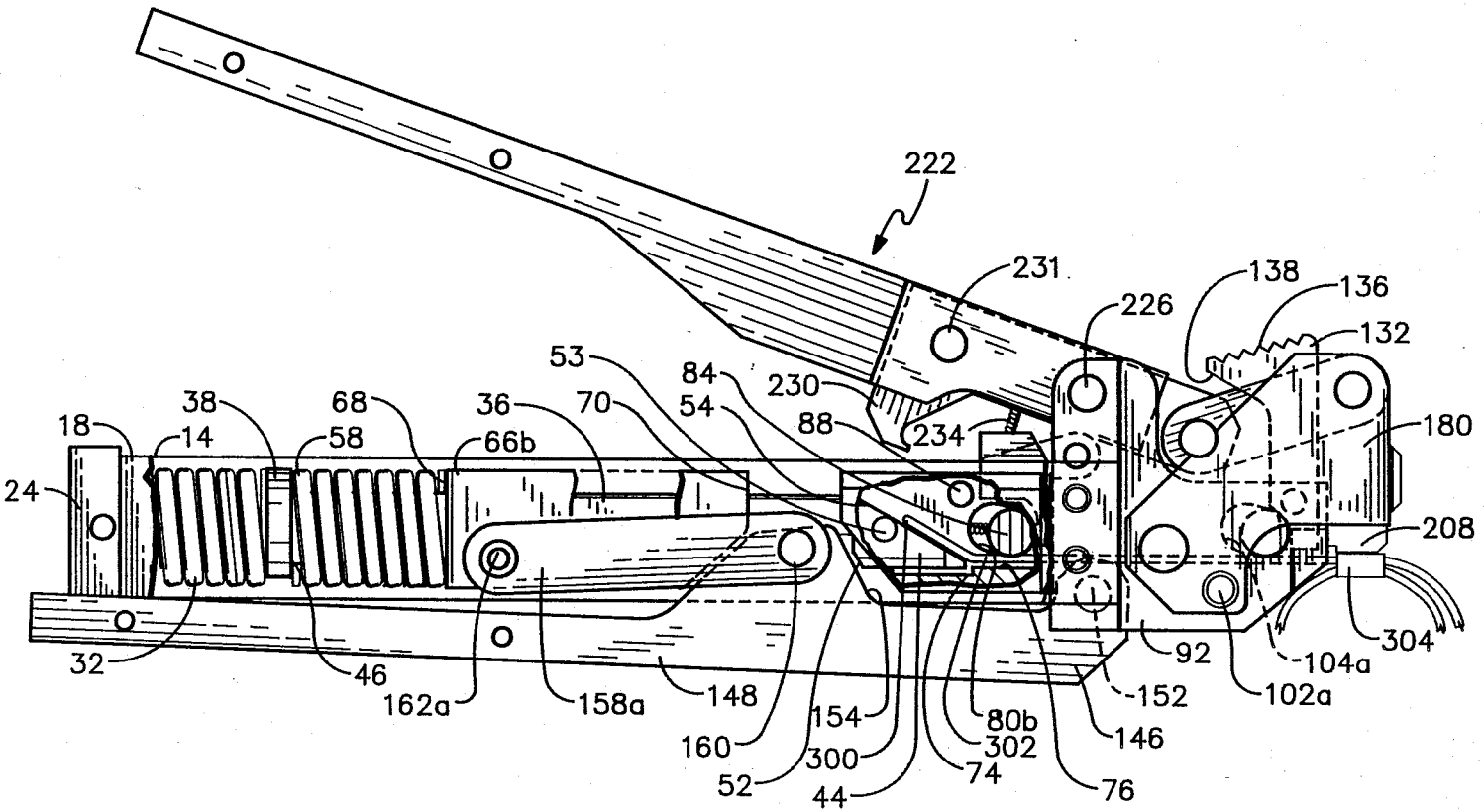
FIG. 5 depicts the apparatus of FIG. 2 but with the pull-up handle in a fourth position.

If, however, the forces produced by the first spring 32 and the tension in the free end of the strap exceed that being applied by the second spring 58, the 45° surface 154 of the pull-up arm 144 will contact the first angled surface 52 of the bridge member 36, as depicted in FIG. 4, thus clearing the bottom side of the slide block bottom 76, permitting complete closure of the pull-up arm 144 and thereby indicating that the desired tension on the free end of the strap has been met or exceeded. Further, once the desired strap tension is attained and the pull-up arm 144 comes into contact with the bridge member 36, the pull-up arm 144 remains in place without the aid of the operator. This allows the operator to then actuate the cutter arm 222 to bend and shear the free end of the strap. As depicted in FIG. 5, the pull-up arm 144 is held in place because the location of the first cutter link pin 238 is now on the upward side of a line drawn between the cutter arm pivot pin 232 and the second cutter link pins 240*a*, 240*b*. Consequently, the second spring 58 tends to maintain the pull-up arm 144 in the closed position. Notably, the desired strap tension can be adjusted by removing the cap end 24 of the body 12 and replacing the first spring 32 with one having a different spring constant or stiffness.

Normally, one power stroke is insufficient to apply the desired tension to the free end of the strap 302. Consequently, the pull-up arm 144 must be opened or retracted so that subsequent power strokes can be applied to achieve the desired tension in the free end of the strap. Retraction is accomplished simply by ceasing to apply force to the pull-up arm 144. This allows the first spring 32 and the tension in the free end of the strap to urge the bridge member 36 toward the forward end of the tool 10. The bridge member 36, in turn, displaces the channel member 62, via the second spring 58, toward the forward end of the tool 10. Forward displacement of the channel member 62 results in the pull-up arm 144 rotating away from the body 12. The pull-up arm 144 is thus urged to its relaxed or open configuration by the combined force of the first spring 32 and second spring 58. In one embodiment, the restoring force of the first spring 32 is about 20 pounds and the restoring force of the second spring 58 is about 150 pounds. Forward movement of the slide block 74 eventually causes the rear roller 84 to slide toward the rear of the rear roller slots 80*a*, 80*b* thereby disengaging the rear roller 84 from the free end of the strap. It is necessary, however, to preserve at least part of the tension produced during the power stroke. Consequently, prior to and during the disengagement of the rear roller 84 from the free end of the strap 302, the front roller 126 is biased toward the front of the front roller slots 104*a*, 104*b* thereby pinching the free end of the strap between the front roller 126 and the blade top surface 116 and preserving the tension produced during the power stroke.

Associated with the tensioning of the free end of the strap by reciprocation of the pull-up arm 144 is the ability of an operator to vary the duty cycle associated with the power stroke. The duty cycle is the percentage of the power stroke during which increasing tension is applied to the free end of a strap. By varying the duty cycle of the power stroke, an operator can adjust the increase in tension applied to the free end of the strap during each power stroke. For example, adjusting the tool 10 to have a relatively small duty cycle results in relatively small increases in tension being applied to the free end of the strap for each power stroke. Consequently if, for example, the desired tension is 10.5 units and the duty cycle is adjusted such that 1 unit of tension is produced for each power stroke, then the tool 10 would indicate, as described hereinabove, that the desired tension had been reached or exceeded when about 11 units of tension had been applied. If, on the other hand, the desired tension is 10.5 units, and the tool 10 is adjusted such that each stroke results in 5 units of tension being applied to the free end of the strap, then the tool 10 would indicate that the desired tension had been reached or exceeded when about 3 units of tension had been applied. The duty cycle is adjusted by the set screw 176 associated with the hammer 166. Adjustment of the set screw 176 causes the hammer 166 to rotate about the hammer pin 174 thereby altering the point at which the rear roller 84 contacts the second concave surface 168. If, for example, the set screw 176 is adjusted such that the second concave surface 168 forces the rear roller 84 toward the rear of the rear roller slots 80*a*, 80*b*, then the duty cycle is reduced since a portion of the power stroke must occur before the rear roller 84 can pinch the free end of the strap against the top side of the slide block bottom 76. Conversely, by adjusting the set screw 176 such that the second concave surface 168 contacts the rear roller 84 toward the front portion of the rear roller slots 80*a*, 80*b*, the duty cycle can be increased with the aforementioned effects.

The tool 10 is also adjustable to accommodate a broad range of desired tensions. A typical desired tension is that which would produce a pressure between the band and the object it is applied to of about 6,000 psi, although other tensions are possible. As previously mentioned, the desired tension is attained when the force being applied by the second spring 58 to the bridge member 36 is equal to the sum of the forces applied by the first spring 32 and the tension on the free end of the strap 302. Consequently, the desired tension can be varied by replacing the first spring 32 with another having a different spring constant or stiffness. Replacement of the first spring 32 is easily accomplished by removing the cap end 24.

Another desirable feature of the tool 10 is the ability to release the free end of the strap from the tool 10. This is normally necessary when, for example, the cable tie has been wrongly positioned. In order to remove the free end of the strap from the tool 10, the pull-up arm 144 must be retracted such that the rear roller 84 is not pinching the strap against the top side of the slide block bottom 76. As described hereinabove, when the tool 10 is in this state, the front roller 126 and its associated parts are maintaining the tension achieved during the power stroke by pinching the free end of the strap against the blade top surface 116. In this state, the operator can release the tool 10 from the free end of the strap by actuating the release lever 132. The operator releases the free end of the strap by using his, typically, thumb to force the knurled surface 136 toward the front of the tool 10 thereby causing the release lever 132 to rotate. Rotation of the release lever 132 causes the first concave surface 134 to contact the front roller 126 and force it toward the rear of the front roller slots 104*a*, 104*b*. Due to the slope of the front roller slots 104*a*, 104*b* actuation of the release lever 132 causes the front roller 126 to disengage from the free end of the strap thereby allowing the free end of the strap to be removed from the tool 10.

Once the desired tension on the free end of the strap is attained, as indicated by the pull-up arm 144 collapsing into the body 12, it is necessary to bend and then shear the free end of the strap. Bending of the free end of the strap serves to attach the free end of the strap to the buckle at the desired tension. The shearing operation is necessary to remove the excess strap so that the cable tie fits flushly to the object or objects being enclosed.

Figure 6:
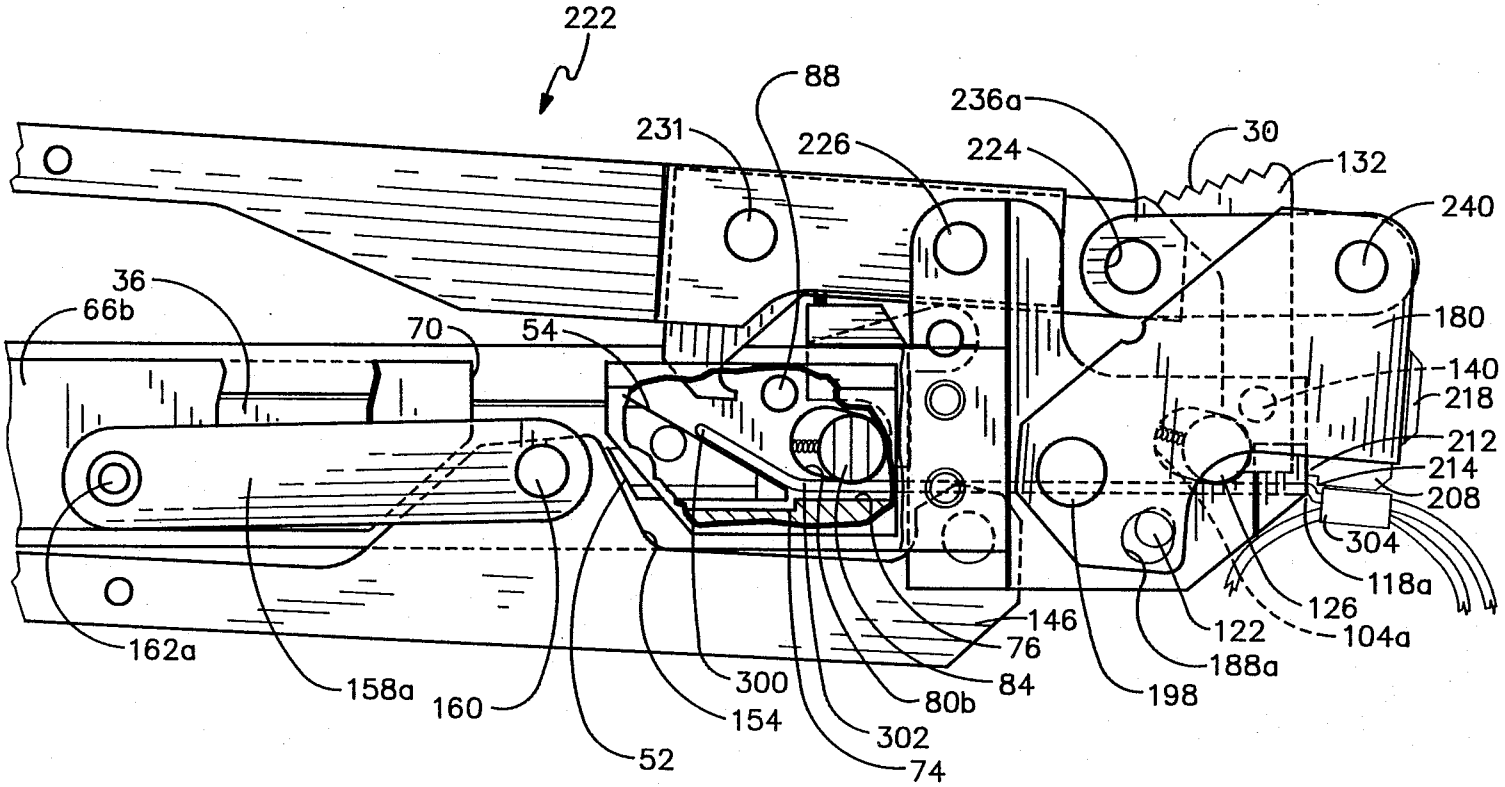
FIG. 6 is a partial side elevational view of the apparatus of the present invention, showing the cut-off handle in a second position and with portions removed to show interior parts.

Bending is accomplished by closing or rotating the cutter arm 222 toward the body 12, as depicted in FIG. 6. This, in turn, causes the cutter links 236*a*, 236*b* to force the cutter 180 to rotate about the cutter pin 198. Rotation of the cutter 180 causes the knife bottom surface 216 to contact the top surface of the buckle associated with the cable tie. At this point there is a bending space defined between the point where the strap contacts the blade edge 118*a* or 118*b* and the point at which the strap exits the buckle. Further rotation of the cutter 180 results in the knife bottom surface 216 forcing the buckle downward relative to the blade 112. As this occurs, the free end of the strap is bent upward around the top edge of the buckle and downward around the blade edge 118*a* or 118*b*. The notch existing between the bending edge 214 and the knife edge 212 provides space for bending the strap around the top edge of the buckle.

Figure 7:
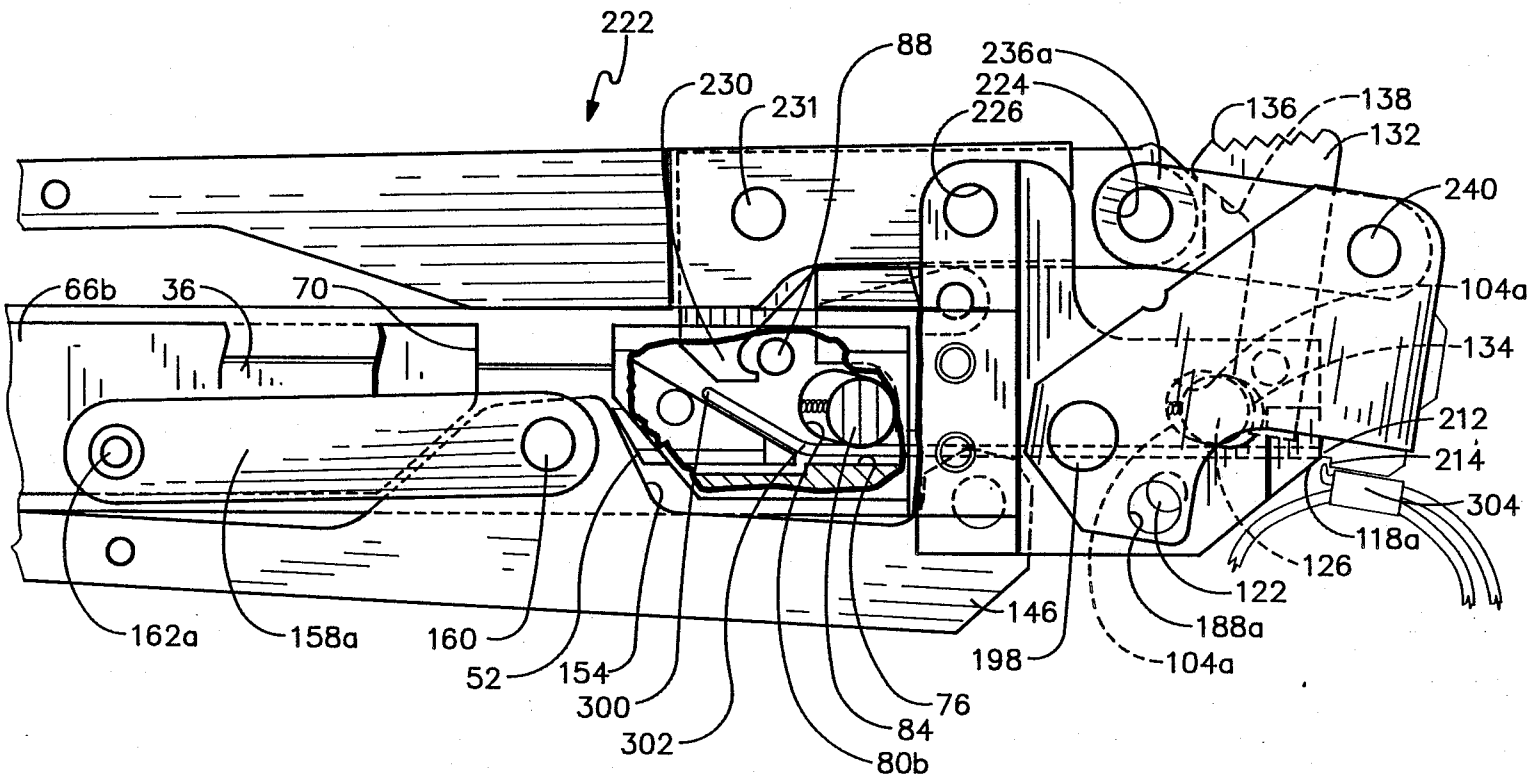
FIG. 7 depicts the apparatus of FIG. 6 but with the cut-off handle in a third position.

Following the bending operation further rotation of the cutter 180, as depicted in FIG. 7, results in the excess strap being sheared between the knife edge 212 and the blade edge 118*a* or 118*b*. The knife edge 212 is substantially closer to the blade edges 118*a* or 118*b*. Consequently, the space between the knife edge 212 and the blade edge 118*a* or 118*b* results in shearing rather than bending of the free end of the strap. In addition, during or after the shearing of the free end of the strap, the front roller 126 is disengaged from the excess strap thereby allowing the operator to remove the excess strap protruding from the first body slot 26. Release of the front roller 126 occurs when the cutter arm link end 224 of the cutter arm 222 causes the release lever 132 to rotate by contacting the cutter arm contact surface 138. Rotation of the release lever 132, as described above, causes the first concave surface 134 to force the front roller 126 toward the rear of the front roller slots 104*a*, 104*b* which, in turn, relieves the pressure on the excess strap substantially simultaneously with the band locking operation. In connection with release of the excess strap, it is particularly advantageous in the present invention that the cut-off end of the excess strap remains substantially straight after the cut-off in order to keep the cut-off excess strap from jamming during removal. It is further particularly advantageous that the bent over or locking portion of the strap be formed in a substantially 90° angle. For this reason, it useful for the rotation of the cutter 180 to be achieved about an axis which passes through or close to the longitudinal axis of the strap in the tool. It is for this reason that the pin 198 has a lower cut-out 202 in order that the pin 198 can be positioned substantially along the longitudinal axis of the strap yet, by means of the cut-out 202, provide for passage of the strap through or close to the axis of rotation of the cutter 180.

Another feature of the tool 10 is the ability to compress both the pull-up arm 144 and the cutter arm 222 against the body 12 thereby allowing the tool 10 to be conveniently stored. To place the tool 10 in storage mode, the pull-up handle 144 must be in its relaxed or open position. The cutter arm 222 is then rotated toward the body 12 such that the hook 230 is located to the rear of the keeper pin 88, as shown in FIG. 7. With the cutter arm 222 depressed, the pull-up arm 144 is rotated toward the body 12 thereby causing the slide block 74 to be rearwardly displaced. The rearward displacement of the slide block 74 results in the keeper pin 88 contacting the hook 230 which prevents further rearward displacement of the slide block 74. The hook 230 holds the slide block 74 and hence the bridge member 36 such that the 45° surface 154 associated with the pull-up arm 144 matingly engages the first angled surface 52 of the bridge member 36. In essence, the hook 230 and the keeper pin 88 operate to maintain the bridge member 36 in the position it would be in if the desired tension on a strap had been attained. Consequently, the pull-up arm 144 can be collapsed into the body 12. The first spring 32 and the second spring 58 then operate to, as previously described, hold the pull-up arm 144 next to the body 12. By placing the tool 10 in storage mode, both the pull-up arm 144 and the cutter arm 222 are compressed against the body 12 thereby allowing the tool 10 to be easily and conveniently stored. In this manner, the effective volume (i.e. storage space required) of the folded storage configuration is less than that of the unfolded, operational configuration.

As will be apparent to those skilled in the art, a number of variations of the described embodiment can be used. A tool can be provided which is activated not by hand but by pneumatic or hydraulic means. For example, a first air cylinder could be used to achieve the tensioning while a second air cylinder could be used to activate the cut-off mechanism. The function of the various spring devices can be achieved by a number of devices for providing force, such as compressional elastic devices, electromagnetic devices, hydraulic devices, and the like. A tool can be provided which contains only a tensioning function without a cut-off function or a cut-off function without a tensioning function. The tool can be provided without adjustability of the tension and/or duty cycle. Linkage connections can be replaced by camming connections. Parts can be connected using, in addition to pins and/or screws, welding, gluing, brazing, soldering, or parts can be integrally formed. The device can be formed of any material having necessary strength and resiliency, preferably a metal such as steel, but can also preferably be formed of plastic, fiberglass or other organics, ceramics, and wood.

Although the present invention has been described with reference to certain embodiments, it should be appreciated that further modifications can be effected within the spirit and scope of the invention.

What is claimed is:

1. An apparatus for tightening and locking a band clamp having a free end usable in a restricted space, comprising:

first means for engaging a first portion of the band clamp, said means comprising a first substantially flat surface and a first substantially smooth body, said smooth body slidably mounted in a slot angled relative to said first flat surface to allow said first smooth body to slide toward said first flat surface to engage said first portion and to slide away from said flat surface to release said first portion;

second means for holding the band clamp relatively more adjacent to the free end than said first means, said second means comprising a second substantially flat surface and a second substantially smooth body, said second smooth body slidably mounted in a second slot angled relative to said second flat surface to allow said second substantially smooth body to slide toward said second flat surface to securely hold the band clamp therebetween and to slide away from said second flat surface to selectively release the band clamp;

third means for pulling the band clamp in a direction defining a longitudinal axis, away from said first portion, to place the band clamp in a tensioned condition; and fourth means for locking the band in said tensioned condition without substantially rotating said longitudinal axis with respect to the band clamp.

2. An apparatus as claimed in claim 1, wherein:

said second means is operably connected to said third means by a pin and a bridge-shaped member.

3. An apparatus, as claimed in claim 1, further comprising:

means for providing a signal when said band clamp tension exceeds a predetermined level.

4. An apparatus, as claimed in claim 1, further comprising:

means for cutting the free end of the band clamp.

5. An apparatus, as claimed in claim 1, further comprising:

means for releasing said first means for engaging.

6. An apparatus, as claimed in claim 1, further comprising:

means for cutting the free end of the band clamp which includes a blade having at least first and second edges, said blade being movable from a first position, wherein said first edge contacts said band clamp during cutting to a second position, wherein said second edge contacts said band clamp during cutting.

7. An apparatus, as claimed in claim 1, wherein:

said apparatus is foldable from a first operational configuration, having a first effective volume to a second storage configuration having a second effective volume which is less than said first effective volume.

8. The apparatus of claim 1, wherein:

said longitudinal axis is generally parallel to said first and second flat surfaces.

9. The apparatus of claim 1, wherein:

said fourth means comprises a portion of said first flat surface and a rotatable knife.

10. An apparatus for shearing a free end of a cable tie adapted to be connected to an object and the cable tie having a second end secured to a buckle, comprising:

first means for operably engaging a first side of the cable tie; and second means for;

cooperating with said first means to bend and shear the free end of the cable tie, wherein after shearing, a sheared free end is formed facing in a direction away from the object and in which said sheared free end is adapted to lock the buckle of the cable tie by substantially preventing relative movement of the buckle and said sheared free end.

11. The apparatus of claim 10, wherein:

said sheared free end is located substantially immediately adjacent the buckle.

12. An easily storable apparatus for tensioning and cutting a band clamp, comprising:

A first lever operably connected to means for cutting the band clamp in a tensioned condition;

a second lever operably connected to means for tensioning the band clamp into said tensioned condition;

means for allowing said first lever to be stored in a reduced space condition after cutting, said means comprising a hook-like portion extending from said first lever and engaging a portion of said means for tensioning; and means for allowing said second lever to be stored in a reduced space condition when said first lever is stored, said means comprising a first angled surface on said second lever for matching with a second angled surface portion of said means for tensioning.

13. A method for tightening and locking a band clamp having a free end usable in a restricted space, comprising the steps of:

engaging a first portion of the band clamp with first means comprising a first substantially flat surface and a first substantially smooth body, said first smooth body slidably mounted in a slot angled relative to said first flat surface to allow said first smooth body to slide toward said first flat surface to engage said first portion and to slide away from said flat surface to release said first portion;

holding the band clamp with second means relatively more adjacent the free end than said first means, said second means comprising a second substantially flat surface and a second smooth body slidably mounted in a second slot angled relative to said second flat surface to allow said second smooth body to slide toward said second flat surface to securely hold the band clamp therebetween and to slide away from said second flat surface to selectively release the band clamp;

pulling the band clamp with third means in a direction defining a longitudinal axis, away from said first means, to place the band clamp in a tensioned condition; and locking the band clamp with fourth means in said tensioned condition without substantially rotating said longitudinal axis with respect to the band clamp.

14. An apparatus for indicating that a desired tension on a cable tie strap has been attained, comprising:

a first linearly sliding body having a first surface, and a second surface, said second surface operably connected to and angled with respect to said first surface, wherein a linear position of said first body relative to at least a portion of the cable tie is related to the tension on the free end of the cable tie strap; and a second body having a third surface and operably connected to said first body such that said third surface contacts said second surface progressively closer to said first surface as tension is increased on the free end of the tie strap, and said third surface contacts said first surface when the tension on the cable tie strap exceeds a predetermined level.

15. An apparatus for adjusting the duty cycle of a power stroke in a reciprocating device for applying tension to the free end of a cable tie strap, comprising:

first means for preventing a tension mechanism from applying tension to the free end of a cable tie strap for a first portion of the power stroke of said reciprocating device; and second means for adjusting the position of said first means to vary the portion of the power stroke during which tension is applied.

16. A method for bending and shearing the free end of a cable tie strap adapted to be connected to an object, the strap having a first side and a second side and a buckle secured to a second end thereof, comprising the steps of:

providing a blade having at least a first edge for engaging the first side of the cable tie strap at a first point;

providing a knife for cooperating with said blade to bend and shear the free end of a cable tie strap, said knife having a second edge for engaging the second side of the cable tie strap at a second point separated from the first point and a third edge for engaging the second side of the cable tie strap at a third point intermediate the first point and the second point; and pinching the free end of the cable tie strap between said blade and said knife wherein the free end of the cable tie strap is bent toward the buckle and away from the object secured by the cable tie strap about said first edge and said second edge and sheared between said first edge and said third edge, wherein a sheared free end is formed, said sheared free end facing in a direction away from the object and locking the buckle by substantially preventing relative movement of the buckle and said sheared free end.

17. A method for locking a free end of a cable tie strap using a buckle secured to a second end of the strap, comprising the steps of:

engaging the buckle with a knife;

bending the free end of the strap toward the buckle and away from an object secured by the strap; and shearing the free end of the strap at a point spaced apart from said bending, wherein said bent and sheared free end is located substantially immediately adjacent the buckle and locks the cable tie strap with the buckle by preventing passage of the buckle over said bent and sheared free end.

18. The method of claim 17, wherein the step of bending comprises:

pinching the free end of the strap between a first edge of said knife and a blade.

19. The method of claim 18, wherein the step of shearing comprises:

moving a second edge of said knife spaced apart from said first edge toward said blade.

* * * * *